US008817060B2

(12) United States Patent
Yamashita

(10) Patent No.: US 8,817,060 B2
(45) Date of Patent: Aug. 26, 2014

(54) OPTICAL DEVICE, CONTROL METHOD FOR THE SAME, AND IMAGE FORMING APPARATUS

(75) Inventor: Hidetoshi Yamashita, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 309 days.

(21) Appl. No.: 13/163,973

(22) Filed: Jun. 20, 2011

(65) Prior Publication Data

US 2012/0007933 A1 Jan. 12, 2012

(30) Foreign Application Priority Data

Jul. 6, 2010 (JP) ..... 2010-154091

(51) Int. Cl.
*B41J 2/435* (2006.01)

(52) U.S. Cl.
USPC ..... 347/236; 347/237; 347/246; 347/247

(58) Field of Classification Search
USPC ..... 347/236
See application file for complete search history.

(56) References Cited

U.S. PATENT DOCUMENTS

| | | | | |
|---|---|---|---|---|
| 6,169,563 | B1 * | 1/2001 | Doi | 347/236 |
| 2003/0030716 | A1 * | 2/2003 | Jeong | 347/132 |
| 2008/0186831 | A1 * | 8/2008 | Tukker et al. | 369/112.01 |
| 2008/0267663 | A1 | 10/2008 | Ichii et al. | |
| 2008/0292342 | A1 * | 11/2008 | Yamashita | 399/51 |
| 2009/0060582 | A1 | 3/2009 | Ichii et al. | |
| 2009/0190943 | A1 | 7/2009 | Yamashita | |
| 2009/0295900 | A1 * | 12/2009 | Ichii | 347/129 |
| 2010/0066799 | A1 | 3/2010 | Yamashita | |
| 2010/0150591 | A1 * | 6/2010 | Yamashita | 399/51 |
| 2011/0032323 | A1 | 2/2011 | Yamashita et al. | |

FOREIGN PATENT DOCUMENTS

| | | |
|---|---|---|
| JP | 5-75802 | 3/1993 |
| JP | 6-106775 | 4/1994 |
| JP | 2002-141605 | 5/2002 |
| JP | 2002-299756 | 10/2002 |
| JP | 2003-182140 | 7/2003 |
| JP | 2004-9465 | 1/2004 |
| JP | 2005-145006 | 6/2005 |
| JP | 2008-74098 | 4/2008 |

OTHER PUBLICATIONS

Extended Search Report issued Nov. 25, 2011 in European Patent Application No. 11171745.0-2209.
Office Action mailed Apr. 1, 2014, in Japanese Patent Application No. 2010-154091.

* cited by examiner

*Primary Examiner* — Sarah Al Hashimi
(74) *Attorney, Agent, or Firm* — Oblon, Spivak, McClelland, Maier & Neustadt, L.L.P.

(57) ABSTRACT

An optical device includes: a light source including a plurality of light emitting spots that output laser beams, respectively; a separating unit that separates each of the laser beams output from the plurality of light emitting spots into a monitor beam and a scanning beam; a light-quantity measuring unit that measures a light quantity of the monitor beam; a storage unit in which respective drive currents with which the plurality of light emitting spots of the light source output a prescribed light quantity of laser beams are stored in advance; a light-source control unit that drives the light source with the drive currents stored in the storage unit and causes the plurality of light emitting spots to output the laser beams; and a determining unit that determines whether the light source operates properly on the basis of the light quantity measured by the light-quantity measuring unit.

13 Claims, 9 Drawing Sheets

FIG.6
| ch | $I_0$ | Vrom |
|---|---|---|
| ch1 | ··· | ··· |
| ch2 | ··· | ··· |
| ⋮ | ⋮ | ⋮ |
| ch7 | ··· | ··· |
| ch8 | ··· | ··· |
FIG.7A
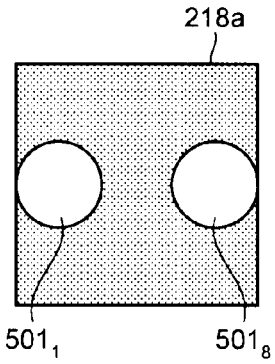
FIG.7B
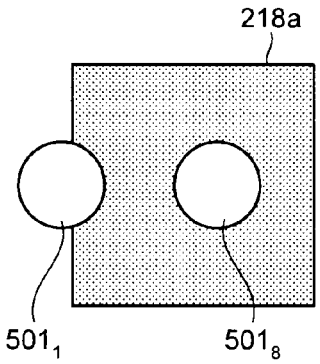
FIG.7C
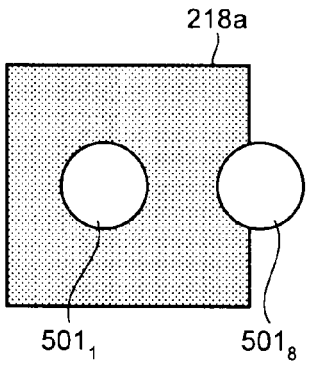

OPTICAL DEVICE, CONTROL METHOD FOR THE SAME, AND IMAGE FORMING APPARATUS

CROSS-REFERENCE TO RELATED APPLICATIONS

The present application claims priority to and incorporates by reference the entire contents of Japanese Patent Application No. 2010-154091 filed in Japan on Jul. 6, 2010.

BACKGROUND OF THE INVENTION

1. Field of the Invention

The present invention relates to an optical device, a control method for the optical device, and an image forming apparatus.

2. Description of the Related Art

An electrophotographic image forming apparatus forms an image in such a manner that an optical writing device exposes an electrostatic charge formed on a photosensitive drum to a laser beam thereby forming an electrostatic latent image on the photosensitive drum, and the electrostatic latent image is developed into an image by application of developer. Conventionally, as a light source of a laser beam, a semiconductor laser element, such as a laser diode (LD), which emits one or a plurality of laser beams from one element has been known. An LD which emits a plurality of laser beams is called an LD array, and an LD array which emits four to eight laser beams is generally used in an image forming apparatus.

Furthermore, in recent years, a surface-emitting laser called "VCSEL (Vertical Cavity Surface Emitting LASER)", which can emit a few dozens (for example, forty) laser beams from one element, has been put to practical use. Accordingly, there has been proposed an image forming apparatus which uses a VCSEL as a laser light source and is capable of forming a high-resolution image at high speed.

To perform image formation using a laser beam, a light quantity of a laser beam to illuminate a photosensitive drum has to be kept constant. A laser diode emits a laser beam in a normal direction, i.e., toward an object to be illuminated as well as a back beam of a light quantity proportional to that of the laser beam in a direction opposite to the laser beam. Conventionally, the light quantity of the laser beam emitted in the normal direction is controlled by means of APC (Auto Power Control) using this back beam.

As a specific example of the APC, a photodiode (PD) is placed as a light receiving element in the same package as a laser diode unit, and the PD receives a back beam. The PD converts the received back beam into an electric current by means of photoelectric conversion, and converts the electric current into a voltage using resistance or the like, and then measures a value of the voltage. A light quantity of the back beam is proportional to a light quantity of a laser beam emitted in the normal direction, so a value of electric current to be applied to a laser diode is controlled so that a measured voltage value is kept constant by feeding back the voltage value. This enables a light quantity of the laser beam emitted in the normal direction to be kept constant.

Here, let us think about the above-described case where one element emits a plurality of laser beams. For example, in the above-described LD array, it is necessary to cause a plurality of back beams corresponding to a plurality of laser beams to enter one PD placed in the LD array; therefore, as the number of laser beams increases, it becomes difficult to perform the APC. Furthermore, for example, in a VCSEL, there is no back beam; therefore, it is not possible to apply the APC using a back beam.

Consequently, when the APC is performed on a plurality of laser beams, there is used the following method: a portion of the laser beam is reflected by a plurality of optical components and used as a monitor beam; a light quantity of the monitor beam is measured; the measured light quantity is converted into a voltage; and a value of the voltage is fed back to a value of drive current. Hereinafter, this APC method using a monitor beam is referred to as a "front monitoring method".

In the front monitoring method, the optical components for reflecting a portion of a laser beam and the PD for receiving a monitor beam reflected by the optical components are arranged to keep a relatively long distance from the LD array or VCSEL. Therefore, for example, when the device including these optical systems is subject to strong impact, the arrangement of the optical components and the PD may change, and an optical axis of the monitor beam with respect to the PD may be shifted, and as a result, the monitor beam may not enter the PD. If the APC is performed in a state where the monitor beam does not enter the PD, a light quantity of the monitor beam detected by the PD becomes about zero, which results in emission of a laser beam with an excess drive current, and this may cause degradation or breakdown of the LD array or VCSEL which is a light source.

Therefore, when the front monitoring method of APC is performed on a laser diode, it is necessary to provide a means of detecting misalignment of an optical axis of a laser beam with respect to a PD.

Conventionally, various technologies applicable to detection of such misalignment of an optical axis of a laser beam with respect to a PD have been proposed and put to practical use. For example, in a technology disclosed in Japanese Patent Application Laid-open No. 2002-141605, a device for measuring a value of voltage correlating with a drive current applied to a light source being subjected to the APC is provided, and the current voltage value is compared with a preset voltage value, and if the current voltage value exceeds the preset voltage value, it is determined that the light source is degraded. Furthermore, a technology disclosed in Japanese Patent Application Laid-open No. 2003-182140, if a drive current of a laser beam exceeds an upper limit of control range of drive amount during the APC, it is determined as malfunction. Moreover, a technology disclosed in Japanese Patent Application Laid-open No. 2008-74098, before the APC of a laser diode is performed, a PD-output-voltage feedback system is shut down, a laser beam is emitted with a prescribed drive current, and an output voltage from a PD at the time is checked, and only if a value of the voltage is within a prescribed value, the APC is performed.

In the technology disclosed in Japanese Patent Application Laid-open No. 2002-141605, although a method to determine degradation of a light source by monitoring a back beam is described, this method can be employed in detection of misalignment of an optical axis of a laser beam with respect to a PD in the front monitoring method. However, according to the technology disclosed in Japanese Patent Application Laid-open No. 2002-141605, abnormality in a value of voltage correlating with a drive current is detected during the APC, so even if an optical axis of a laser beam with respect to the PD is shifted, the APC is executed. Therefore, the light source is driven with a drive current based on a voltage value exceeding the preset voltage value, and this may cause degradation or breakdown of the normal LD array or VCSEL.

In Japanese Patent Application Laid-open No. 2002-141605, the preset voltage value is a value determined by taking variations of optical writing devices into account, and a largish acceptable value is generally set to the voltage value so as to prevent any optical writing devices from determining malfunction incorrectly. Therefore, even if a drive current is controlled to be within the acceptable value, an excess amount of current is likely to be supplied to the LD array or VCSEL, and there is a high possibility of causing degradation or breakdown of the LD array or VCSEL.

Also in the technology disclosed in Japanese Patent Application Laid-open No. 2003-182140, in the same manner as Japanese Patent Application Laid-open No. 2002-141605, even if an optical axis of a laser beam with respect to a PD is shifted, the APC is executed at least once. In this case, the LD array or VCSEL is driven with a drive current which is out of a predetermined range, so there is a possibility of causing degradation or breakdown of the normal LD array or VCSEL.

On the other hand, according to the technology disclosed in Japanese Patent Application Laid-open No. 2008-74098, before the APC is performed on the LD, the PD-output-voltage feedback system is shut down and an output voltage from the PD is checked, and the APC is performed if a value of the voltage is within a prescribed range; therefore, it is possible to prevent degradation or breakdown of the LD array or VCSEL due to the APC like in Japanese Patent Application Laid-open No. 2002-141605.

However, in general, a laser light source, such as an LD array or a VCSEL, varies greatly in a quantity of light emitted according to an amount of individual drive current; therefore, when the laser light source emits laser beams with a prescribed drive current, a light quantity of the emitted laser beams runs over a wide range in each device, and a prescribed range of voltage from the PD to be determined before the APC is performed has to be set to a wide range. Therefore, when the method according to Japanese Patent Application Laid-open No. 2008-74098 is applied to detection of misalignment of an optical axis of a monitor beam with respect to the PD, it is not possible to expect high-accuracy detection.

Furthermore, besides misalignment of an optical axis of a monitor beam with respect to the PD, a decrease in output voltage from the PD may occur when a light quantity of a laser beam extremely drops due to degradation of the LD array or VCSEL provided as a light source or when no laser beam is emitted due to breakdown of the LD array or VCSEL. In the method disclosed in Japanese Patent Application Laid-open No. 2008-74098, when a decrease in output voltage from the PD is confirmed, it is not possible to determine whether the decrease in output voltage arises from misalignment of an optical axis of a monitor beam with respect to the PD. Therefore, when a decrease in output voltage from the PD is confirmed, both the PD and the light source have to be replaced.

An LD array and a VCSEL are very expensive as compared with an ordinary semiconductor laser; thus, breakdown of the normal light source is caused by performing the APC in a state where there is optical-axis misalignment, which further causes a negative effect of an increase in servicing or maintenance cost. Therefore, to employ the front monitoring method of APC, a method capable of detecting misalignment of an optical axis of a laser beam with respect to a PD with a high degree of accuracy is required.

SUMMARY OF THE INVENTION

It is an object of the present invention to at least partially solve the problems in the conventional technology.

According to an aspect of the present invention, there is provided an optical device includes: a light source that includes a plurality of light emitting spots that output laser beams, respectively; a separating unit that separates each of the laser beams output from the plurality of light emitting spots into a monitor beam and a scanning beam; a light-quantity measuring unit that measures a light quantity of the monitor beam; a storage unit in which respective drive currents with which the plurality of light emitting spots of the light source output a prescribed light quantity of laser beams are stored in advance; a light-source control unit that drives the light source with the drive currents stored in the storage unit and causes the plurality of light emitting spots to output the laser beams; and a determining unit that determines whether the light source operates properly on the basis of the light quantity measured by the light-quantity measuring unit.

According to another aspect of the present invention, there is provided a control method performed by an optical device, the method includes: separating, by a separating unit, each of laser beams output from a plurality of light emitting spots included in a light source into a monitor beam and a scanning beam; measuring, by a light-quantity measuring unit, a light quantity of the monitor beam; driving, by a light-source control unit, the light source with drive currents stored in a storage unit and causing, by the light-source control unit, the plurality of light emitting spots to output the laser beams, the drive currents with which the light emitting spots of the light source output a prescribed light quantity of laser beams, respectively, being stored in the storage unit in advance; and determining, by a determining unit, whether the light source operates properly on the basis of the light quantity measured at the measuring.

According to still another aspect of the present invention, there is provided an image forming apparatus including: an optical device; an image forming unit; and a light-quantity control unit, wherein the optical device includes: a light source that includes a plurality of light emitting spots that output laser beams, respectively; a separating unit that separates each of the laser beams output from the plurality of light emitting spots into a monitor beam and a scanning beam; a light-quantity measuring unit that measures a light quantity of the monitor beam; a storage unit in which respective drive currents with which the plurality of light emitting spots of the light source output a prescribed light quantity of laser beams are stored in advance; a light-source control unit that drives the light source with the drive currents stored in the storage unit and causes the plurality of light emitting spots to output the laser beams; and a determining unit that determines whether the light source operates properly on the basis of the light quantity measured by the light-quantity measuring unit, the image forming unit forms an image using the scanning beam separated by the separating unit, and the light-quantity control unit performs feedback control of drive current to the light-source control unit on the basis of a light quantity of the monitor beam measured by the light-quantity measuring unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 6 is a schematic diagram showing an example of an IL table showing a correspondence relation between a drive current $T_0$ and an adjustment monitor voltage Vrom when a laser beam of a prescribed light quantity $L_0$ is emitted;

FIGS. 7A to 7C are schematic diagrams showing examples of a positional relation between beam spots formed by monitor beams and a light receiving surface of a light receiving element;

DETAILED DESCRIPTION OF THE PREFERRED EMBODIMENTS

Figure 1:
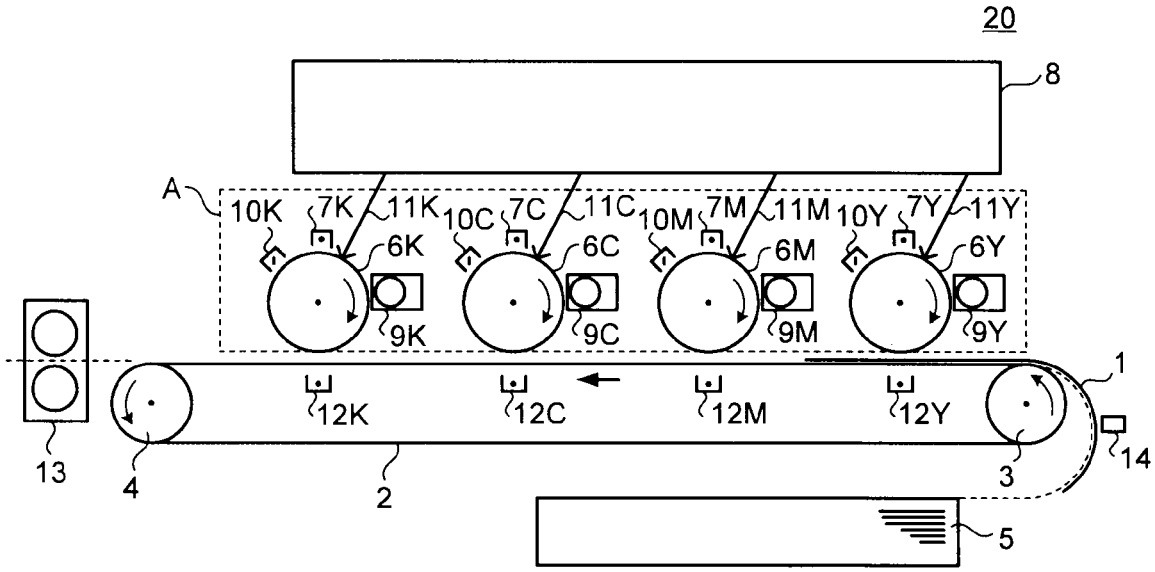
FIG. 1 is a schematic diagram schematically showing an example of a configuration of an image forming apparatus applicable to respective optical devices according to embodiments of the present invention.

Exemplary embodiments of an optical device according to the present invention are explained in detail below with reference to the accompanying drawings. FIG. 1 schematically shows an example of a configuration of an image forming apparatus 20 applicable to respective optical devices 100 according to the embodiments of the present invention. This image forming apparatus 20 is a tandem-type color image forming apparatus capable of forming a color image using yellow (Y), magenta (M), cyan (C), and black (K) toners.

In the image forming apparatus 20, image forming units A for forming Y, M, C, and K color images are arranged to line up along a conveyance belt 2 for conveying a transfer sheet 1. The conveyance belt 2 is supported by conveyance rollers 3 and 4, and is driven to rotate in a direction of arrow shown in FIG. 1 by the rotation of the conveyance rollers 3 and 4. The conveyance rollers 3 and 4 are a set of a drive roller and a driven roller; the drive roller is driven to rotate, and the driven roller rotates in accordance with the rotation of the drive roller.

A sheet tray 5 in which transfer sheets 1 are contained is provided below the conveyance belt 2. At the time of forming an image, the top transfer sheet out of the transfer sheets 1 contained in the sheet tray 5 is fed, and in mid-course of the feeding of the transfer sheet 1, attracted onto the conveyance belt 2 by the action of electrostatic attraction at a timing determined by a registration sensor 14, i.e., a timing along with the operation of an optical unit for writing an image.

The attracted transfer sheet 1 is conveyed to a first image forming unit for forming a Y-color image, and a Y-color image is formed on the transfer sheet 1 in the first image forming unit. The first image forming unit includes as components a photosensitive drum 6Y and a charger 7Y, an exposure device 8, a developing unit 9Y, a photosensitive-drum cleaning unit 10Y, and the like which are arranged around the photosensitive drum 6Y. After the surface of the photosensitive drum 6Y is uniformly charged by the charger 7Y, the photosensitive drum 6Y is exposed to a laser light 11Y corresponding to the Y-color image by the exposure device 8, and an electrostatic latent image is formed thereon.

Incidentally, the electrostatic latent image is formed by the main and sub-scanning method of optical beam writing. The scanning by a beam emitted from the exposure device 8 is referred to as main scanning, and the rotation of the photosensitive drum perpendicular to the main scanning is referred to as sub-scanning. The photosensitive surface of the drum is exposed to an optical beam corresponding to a two-dimensional image by the main and sub-scanning method, whereby an electrostatic latent image is formed on the surface of the photosensitive drum.

The electrostatic latent image formed on the surface of the photosensitive drum 6Y is developed into a Y-toner image by the developing unit 9Y. Namely, the Y-toner image is formed on the photosensitive drum 6Y. The Y-toner image on the photosensitive drum 6Y is transferred onto the transfer sheet 1 by a transfer unit 12Y at the position where the photosensitive drum 6Y comes in contact with the transfer sheet 1 on the conveyance belt 2 (the transfer position), and a Y-color image is formed on the transfer sheet. After the Y-toner image is transferred onto the transfer sheet 1, unwanted toner remaining on the surface of the photosensitive drum 6Y is cleaned by the photosensitive-drum cleaning unit 10Y to prepare for next image formation.

The transfer sheet 1 on which the Y-toner image is formed in the first image forming unit is conveyed to a second image forming unit for forming an M-color image along with the movement of the conveyance belt 2. In the second image forming unit, in the same manner as in the first image forming unit described above, an M-toner image is formed on a photosensitive drum 6M, and transferred onto the transfer sheet 1 so as to be superimposed on the already-formed Y-toner image. The transfer sheet 1 is next conveyed to a third image forming unit for forming a C-color image and then conveyed to a fourth image forming unit for forming a K-color image, and, in the same manner as the cases of the Y and M color images described above, the formed C and K toner images are transferred onto the transfer sheet 1 so as to be superimposed onto the last-formed toner image. When the Y, M, C, and K toner images have been transferred onto the transfer sheet 1, a color image is formed on the transfer sheet 1.

The transfer sheet 1 on which the color image is formed exits from the fourth image forming unit, and is detached from the conveyance belt 2; and then conveyed to a fixing unit 13. In the fixing unit 13, the color image is fixed on the transfer sheet 1, and after that, the transfer sheet 1 is discharged out of the apparatus.

Figure 2:
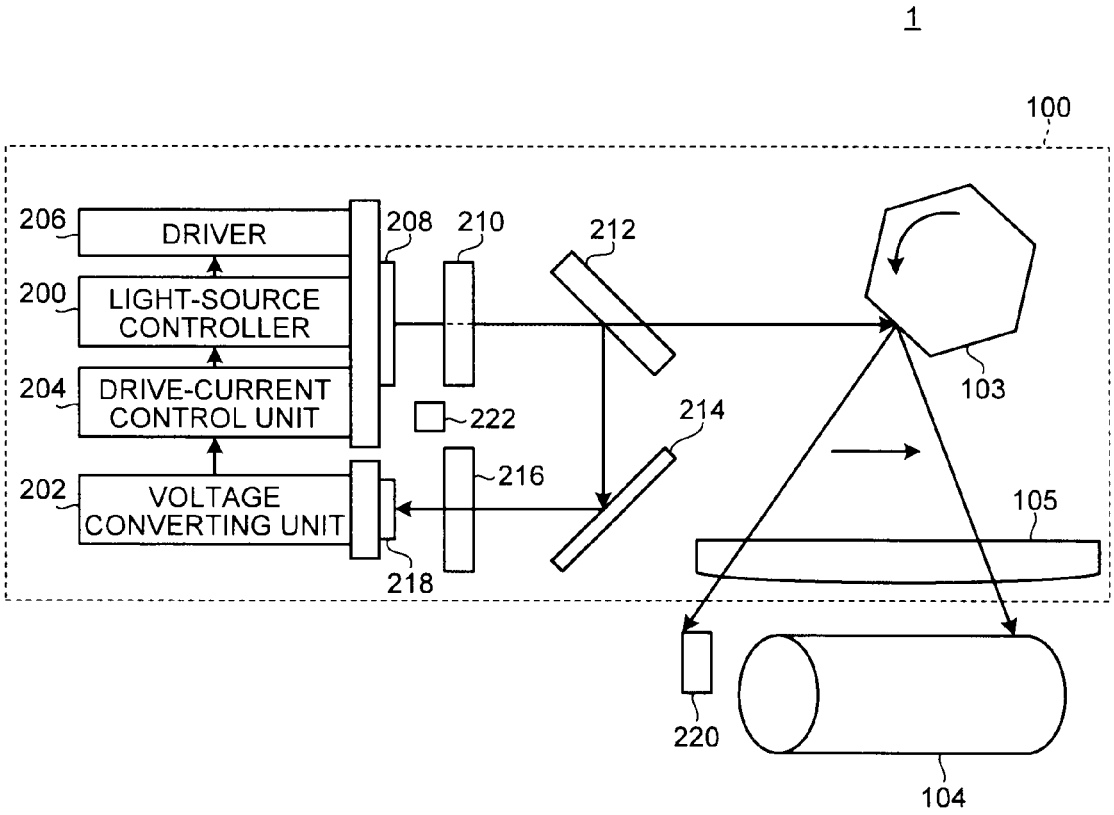
FIG. 2 is a schematic diagram schematically showing an example of a configuration of an optical device included in an exposure unit of the image forming apparatus.

FIG. 2 schematically shows an example of a configuration of the optical device 100 included in the exposure device 8 of the image forming apparatus 20 shown in FIG. 1. The optical device 100 includes a light source unit which emits a laser beam; a light receiving unit which receives the laser beam emitted from the light source unit to measure a light quantity of the laser beam; and an optical system for bringing the laser beam emitted from the light source unit to a photosensitive drum 104. Incidentally, the photosensitive drum 104 represents photosensitive drums 6K, 6C, 6M, and 6Y shown in FIG. 1.

In the optical device 100, the light source unit includes a laser beam source 208 capable of emitting a plurality of laser beams as well as a light-source controller 200, a drive-current control unit 204, and a driver 206 which are involved in drive control of the laser beam source 208. The light-source controller 200 is composed of, for example, an application specific integrated circuit (ASIC). Furthermore, the light source unit further includes a temperature sensor 222 for measuring a temperature around the laser beam source 208.

The optical system includes a coupling optical element 210, a light separating element 212, a total reflecting mirror 214, a condensing lens 216, a polygon mirror 103, and an f-theta lens 105. A laser beam emitted from the laser beam source 208 are shaped into a parallel light by the coupling optical element 210, and then separated into a monitor beam and a scanning beam by the light separating element 212. Incidentally, the light separating element 212 is an element which lets a portion of a laser beam therethrough and reflects the rest of the laser beam; for example, a half mirror is used as the light separating element 212. The beam reflected by the light separating element 212 is a monitor beam, and the beam passing through the light separating element 212 is a scanning beam.

The scanning beam passing through the light separating element 212 is deflected by the polygon mirror 103 rotating at a predetermined speed, and passes through the f-theta lens 105, and then illuminates the photosensitive drum 104. The scanning beam scans the photosensitive drum 104 in a main scanning direction in accordance with rotation of the polygon mirror 103. Incidentally, a synchronization detecting unit 220 is placed at the scanning start position of the photosensitive drum 104. The synchronization detecting unit 220 includes, for example, a photodiode (PD) as a light receiving element, and outputs a synchronization signal for giving the timing of various controls including correction of a light quantity. The output from the synchronization detecting unit 220 is supplied to a CPU (not shown).

The monitor beam reflected by the light separating element 212 is totally reflected by the total reflecting mirror 214, and passes through the condensing lens 216, and then enters the light receiving unit including a light receiving element 218 and a voltage converting unit 202 and is received by the light receiving element 218. The light receiving element 218 is, for example, a photodiode (PD). The light receiving element 218 converts the beam received by a light receiving surface thereof into a current depending on a light quantity of the received beam by means of photoelectric conversion, and outputs the current. The voltage converting unit 202 converts the current output from the light receiving element 218 into a voltage with a resistance element or the like, and supplies the voltage as a light-quantity monitor voltage Vpd to the drive-current control unit 204.

The drive-current control unit 204 generates a value of drive current for driving the laser beam source 208, and supplies the drive current value to the light-source controller 200. Furthermore, the drive-current control unit 204 updates the drive current value on the basis of the light-quantity monitor voltage Vpd supplied from the voltage converting unit 202 of the light receiving unit, and outputs the updated drive current value to the light-source controller 200.

The light-source controller 200 receives a control signal from a main CPU (not shown) which controls image formation in the image forming apparatus 20, and performs drive control of the laser beam source 208 on the basis of the received control signal. At this time, the light-source controller 200 generates a drive signal for indicating the driver 206 the drive current value supplied from the drive-current control unit 204. The drive signal is generated with respect to each channel of the laser beam source 208 independently.

Furthermore, when image data is supplied to the light-source controller 200 from an image processing unit (not shown), the light-source controller 200 generates a drive signal for driving the laser beam source 208 on the basis of the image data and a control signal received from the main CPU.

Moreover, the light-source controller 200 performs line APC (Auto Power Control) on the laser beam source 208 in response to an instruction from the main CPU. The line APC means control to perform correction of a light quantity of a laser beam each time the laser beam scans in the main scanning direction. Furthermore, when the light-source controller 200 receives a result of temperature measurement by the temperature sensor 222, the light-source controller 200 corrects a light quantity of a laser beam emitted from the laser beam source 208 on the basis of the result of temperature measurement.

The driver 206 generates drive currents for driving the channels of the laser beam source 208, respectively, on the basis of respective drive signals for the channels of the laser beam source 208 supplied from the light-source controller 200. The laser beam source 208 turns on the channels and emits laser beams from the channels in accordance with the drive currents for the channels supplied from the driver 206.

First Embodiment

Figure 3:
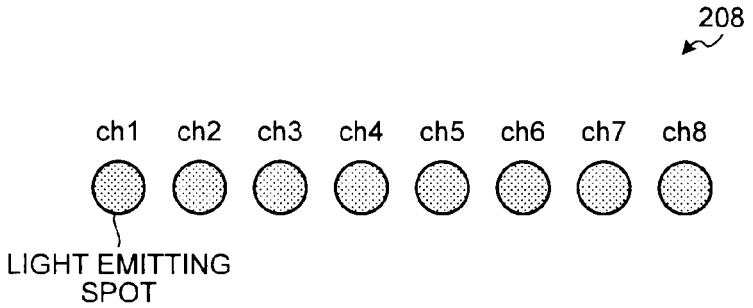
FIG. 3 is a schematic diagram showing an example of an array of light emitting spots in an LD array used as a laser beam source.

Subsequently, a first embodiment of the present invention is explained. In the present first embodiment, a laser diode array (hereinafter, referred to as an "LD array") in which a plurality of light emitting spots are arrayed in alignment is used as the laser beam source 208. For example, an LD array capable of emitting eight laser beams corresponding to eight channels is used as the laser beam source 208. FIG. 3 shows an example of an array of the light emitting spots in the LD array used as the laser beam source 208. In the laser beam source 208, eight light emitting spots corresponding to channels ch1 to ch8 are arrayed in alignment at equally-spaced intervals. Incidentally, the number of laser beams that the laser beam source 208 can emit is not limited to eight.

Figure 4:
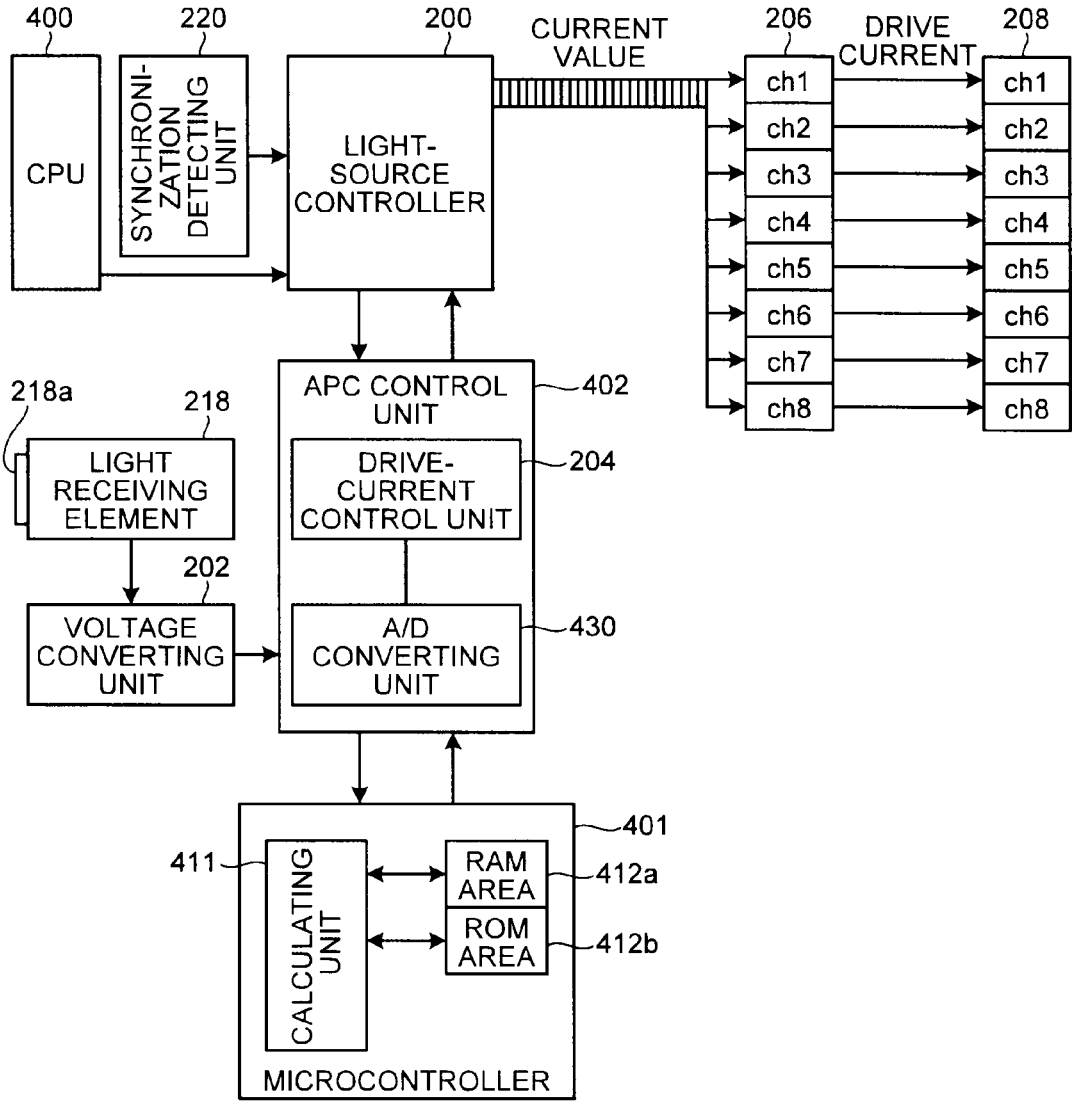
FIG. 4 is a block diagram showing an example of a more detailed configuration of a light source unit and a light receiving unit in an optical device applicable to a first embodiment of the present invention.

FIG. 4 shows an example of a more detailed configuration of the light source unit and the light receiving unit in the optical device 100 applicable to the present first embodiment. Incidentally, in FIG. 4, parts in common with those in FIG. 2 are assigned the same reference numerals, and detailed description of the parts is omitted.

A CPU 400 is a main CPU for controlling image formation in the image forming apparatus 20 including the optical device 100. The light-source controller 200 receives a control signal from the CPU 400, and starts initialization of the laser beam source 208 or APC processing on the laser beam source 208. An APC control unit 402 includes the drive-current control unit 204 and an A/D converting unit 430, and supplies a digital value into which an analog signal of a light-quantity monitor voltage Vpd supplied from the voltage converting unit 202 is converted by the A/D converting unit 430 to the drive-current control unit 204.

A microcontroller 401 includes a calculating unit 411 and a memory including a random access memory (RAM) area 412*a* and a read-only memory (ROM) area 412*b*. In the ROM area 412*b*, a program for operating the microcontroller 401 as well as default values of various control values used by the drive-current control unit 204 and various factory default adjustment values, etc. are stored in advance. The RAM area 412*a* is used, for example, as a registration memory used by the calculating unit 411.

The various adjustment values stored in the ROM area 412*b* of the memory, which are set in factory adjustment, are explained more specifically. In the ROM area 412*b*, information on a relation between a light quantity of a laser beam to illuminate the photosensitive drum 104 and a light-quantity monitor voltage Vpd (an output value from the A/D converting unit 430), which are measured in factory adjustment, is stored.

Furthermore, in the ROM area 412*b*, a drive current and a light-quantity monitor voltage Vpd when a laser beam of a prescribed light quantity is emitted from each channel of the laser beam source 208, which is measured in factory adjustment, are stored in an associated manner on a channel-by-channel basis. The prescribed light quantity is a light quantity close to the maximum rated light quantity of a laser beam emitted from the laser beam source 208; for example, the prescribed light quantity is a 90% of the maximum rated light quantity of a laser beam emitted.

Figure 5:
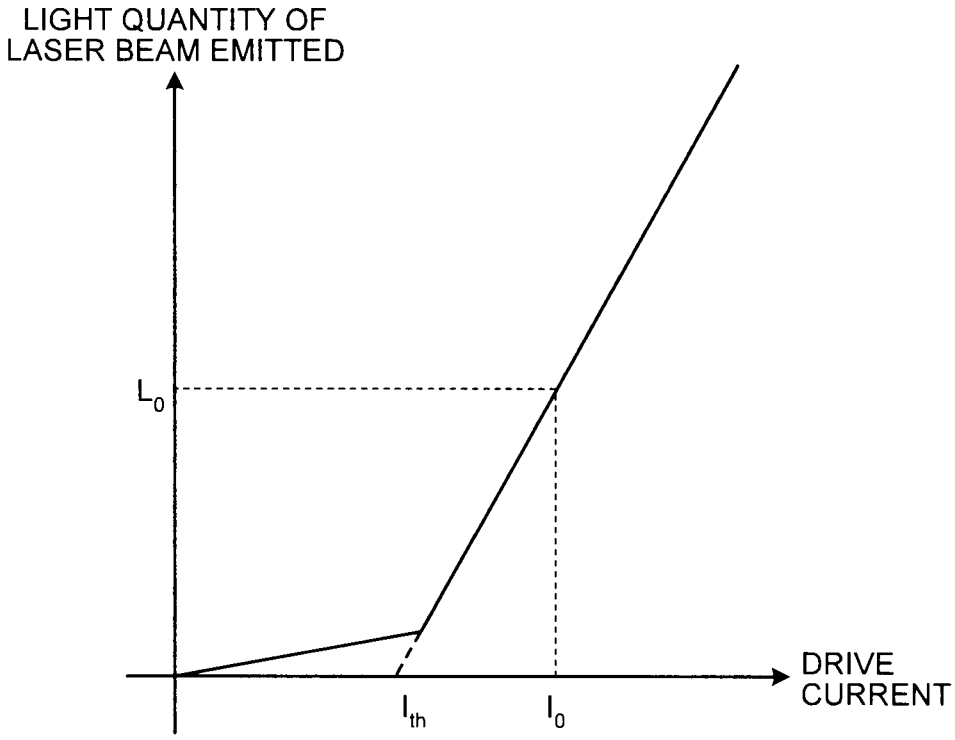
FIG. 5 is a schematic diagram showing an example of a relation between a drive current I and a light quantity L of a laser beam emitted from an LD.

FIG. 5 shows an example of a relation between a drive current I and a light quantity L of a laser beam emitted from the LD. When a drive current I exceeds a threshold value $I_{th}$, the LD starts laser oscillation and emits a laser beam. When a drive current I increases higher than the threshold value $I_{th}$, a light quantity L of a laser beam emitted increases roughly in proportion to the drive current I until the drive current I reaches an absolute maximum rated current of the LD. A light quantity of a laser beam emitted from the LD with the absolute maximum rated drive current I is the maximum rated light quantity of laser beam emitted; a drive current required for the LD to emit a laser beam of a prescribed light quantity $L_0$ is a drive current $I_0$. As a light quantity L of a laser beam emitted from the LD is approximately proportional to a light-quantity monitor voltage Vpd, a light quantity L of a laser beam emitted can be expressed in a light-quantity monitor voltage Vpd.

The measurement of a value of drive current when the laser beam source 208 emits laser beams of a prescribed light quantity is performed, for example, as follows. By operating the light-source controller 200 with a factory jig or the like, a value of drive current for driving a light emitting unit (referred to as a "light emitting channel") subject to measurement in a plurality of channels of light emitting units of the laser beam source 208 is set in the drive-current control unit 204 in such a manner that the drive current value is gradually increased from zero. While increasing the drive current value, a light quantity of a laser beam emitted from the light emitting channel of the laser beam source 208 is measured by a power meter. On the other hand, a monitor beam enters the light receiving element 218, and the A/D converting unit 430 outputs a light-quantity monitor voltage Vpd.

When a light quantity of an emitted laser beam measured by the power meter reaches the prescribed light quantity $L_0$, the increase of the drive current value is stopped, and a drive current (a drive current $I_0$) and a light-quantity monitor voltage Vpd at this point are written on the ROM area 412*b* of the microcontroller 401 in an associated manner. This process is performed with respect to each of the channels of the laser beam source 208. Hereinafter, the light-quantity monitor voltage Vpd corresponding to the prescribed light quantity $L_0$ stored in the ROM area 412*b* is referred to as an "adjustment monitor voltage Vrom".

FIG. 6 shows an example of an IL table showing a correspondence relation between a drive current $I_0$ and an adjustment monitor voltage Vrom, which are stored in the ROM area 412*b*, when each channel of the laser beam source 208 emits a laser beam of the prescribed light quantity $L_0$. In the IL table, respective drive currents $I_0$ and adjustment monitor voltages Vrom of the channels (the channels ch1 to ch8, in this example) of the laser beam source 208 are stored in an associated manner.

Determination of Optical-Axis Misalignment According to the First Embodiment

Subsequently, a method of determining optical-axis misalignment according to the present first embodiment is explained. FIGS. 7A to 7C show examples of a positional relation between a light receiving surface 218*a* of the light receiving element 218 and beam spots formed by monitor beams. FIG. 7A shows an example in which there is no misalignment of optical axes of the monitor beams with respect to the light receiving element 218. In this manner, monitor beams and the light receiving element 218 are configured so that beam spots formed by the monitor beams of all the channels of the laser beam source 208 enter the light receiving surface 218*a* of the light receiving element 218 without any lack. In this case, light-quantity monitor voltages Vpd generated by the monitor beams of all the channels are roughly equal to corresponding adjustment monitor voltages Vrom of the channels, respectively.

On the other hand, when there is misalignment of the optical axis of the monitor beam with respect to the light receiving element 218 as shown in FIGS. 7B and 7C, either one of beam spots $\mathbf{501}_1$ and $\mathbf{501}_8$ formed by the monitor beams of the channels ch1 and ch8 at both ends of the laser beam source 208 deviates from the light receiving surface 218*a*. A light-quantity monitor voltage Vpd generated by the beam spot which deviates from the light receiving surface 218*a* is lower than the corresponding adjustment monitor voltage Vrom of the channel. Therefore, it is possible to determine whether there is misalignment of the optical axis of any monitor beam with respect to the light receiving element 218 in such a manner that these channels ch1 and ch8 are each caused to emit a laser beam separately thereby obtaining a light-quantity monitor voltage Vpd.

For example, in FIG. 7B, a portion of the spot $\mathbf{501}_1$ corresponding to the channel ch1 deviates from the light receiving surface 218*a*. In this case, the beam spot formed by the monitor beam of the channel ch1 enters the light receiving surface 218*a* in a state where a portion of the beam spot is lacked, and thus a light quantity of the beam spot received by the light receiving surface 218*a* is smaller than that is when the beam spot enters the light receiving surface 218*a* without any lack. Therefore, a light-quantity monitor voltage Vpd generated by the monitor beam of the channel ch1 is lower than the corresponding adjustment monitor voltage Vrom, and thus it can be determined that there is misalignment of the optical axis of the monitor beam with respect to the light receiving element 218.

In this manner, in the present first embodiment, two channels at both ends of the channel array of the laser beam source 208, i.e., two channels that there is no channel next to one side thereof on the line of the channel array are each caused to emit a laser beam separately, thereby obtaining a light-quantity monitor voltage Vpd. The channels at both ends of the channel array are, in other words, two channels placed at the longest distance between them in the channels of the channel array. Then, the obtained light-quantity monitor voltage Vpd is compared with the corresponding adjustment monitor voltage Vrom of the channel, and whether there is misalignment of the optical axis of the laser beam with respect to the light receiving element 218 is determined.

When the light-quantity monitor voltages Vpd of the channels at both ends of the channel array of the laser beam source 208 are both lower or higher than the corresponding adjustment monitor voltages Vrom of the channels by a predetermined value, it can be considered that the laser beam source 208 is degraded or broken down.

Figure 8:
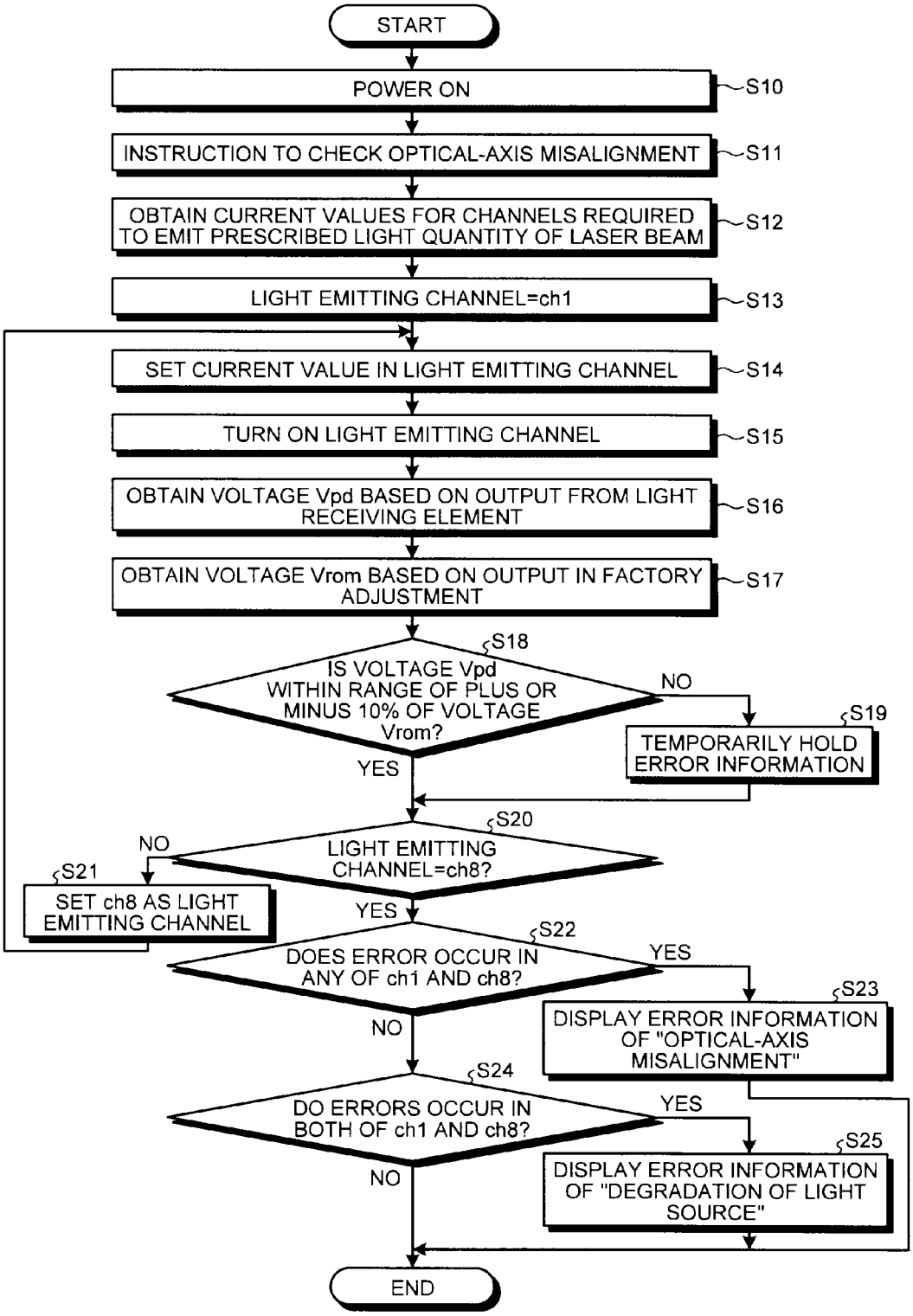
FIG. 8 is a flowchart showing an example of a process for checking optical-axis misalignment according to the first embodiment of the present invention.

FIG. 8 is a flowchart showing an example of a process for checking optical-axis misalignment according to the present first embodiment. Here, the laser beam source 208 has eight channels ch1 to ch8 as shown in FIG. 3. When the light-source controller 200 receives an instruction to check optical-axis misalignment transmitted from the CPU 400 triggered by, for example, power-on of the image forming apparatus 20 (Steps S10 and S11), the process proceeds to Step S12.

At Step S12, the light-source controller 200 requests the microcontroller 401 for respective drive current values required for the channels ch1 to ch8 of the laser beam source 208 to emit a prescribed light quantity of a laser beam. In response to this request, the microcontroller 401 obtains respective drive currents $I_0$ corresponding to the channels ch1 to ch8 with reference to the IL table stored in the ROM area 412*b*, and passes the obtained drive currents $I_0$ to the light-source controller 200. At this time, a channel subject to detection of a light quantity of a monitor beam for checking optical-axis misalignment is the channels ch1 to ch8 only, and therefore the microcontroller 401 can be configured to obtain respective drive currents $I_0$ corresponding to these channels ch1 to ch8. Then, at next Step S13, the light-source controller 200 sets the channel ch1 at one end of the laser beam source 208 as a channel to emit a laser beam. Hereinafter, the channel set as a channel to emit a laser beam in the laser beam source 208 is referred to as a "light emitting channel".

At next Step S14, the light-source controller 200 sets the drive current $I_0$ corresponding to the light emitting channel in the drive currents $I_0$ obtained at Step S12 in the light emitting channel, and turns on the light emitting channel and causes the light emitting channel to emit a laser beam (Step S15). At next Step S16, the light-source controller 200 obtains a light-quantity monitor voltage Vpd depending on a light quantity of the laser beam emitted from the light emitting channel.

Namely, the laser beam emitted from the light emitting channel is partially separated by the light separating element 212, and is reflected by the total reflecting mirror 214, and then, as a monitor beam, enters the light receiving element 218 via the condensing lens 216. The light receiving element 218 outputs a current depending on the intensity of the received monitor beam. The output current from the light receiving element 218 is converted into a voltage by the voltage converting unit 202, and further converted into a digital value by the A/D converting unit 430, and then passed to the light-source controller 200 as a light-quantity monitor voltage Vpd.

At next Step S17, the light-source controller 200 requests the microcontroller 401 for an adjustment monitor voltage Vrom of the light emitting channel. In response to this request, the microcontroller 401 reads out the adjustment monitor voltage Vrom corresponding to the light emitting channel with reference to the IL table stored in the ROM area 412*b*, and passes the read adjustment monitor voltage Vrom to the light-source controller 200.

When the light-source controller 200 has obtained the adjustment monitor voltage Vrom corresponding to the light emitting channel, at next Step S18, the light-source controller 200 determines whether the light-quantity monitor voltage Vpd obtained at Step S16 is within a predetermined allowable range of light-quantity monitor voltage Vpd with respect to the adjustment monitor voltage Vrom (for example, within a range of plus or minus 10% of the adjustment monitor voltage Vrom).

Incidentally, the allowable range of light-quantity monitor voltage Vpd with respect to the adjustment monitor voltage Vrom is preferably set to a value allowing fluctuation in a light quantity of a laser beam emitted due to a difference in temperature around the laser beam source 208 between in factory adjustment and in actual operation. When a temperature around the laser beam source 208 in actual operation can be measured, the adjustment monitor voltage Vrom is corrected depending on a difference in temperature between in factory adjustment and in actual operation, so that the allowable range of the light-quantity monitor voltage Vpd with respect to the adjustment monitor voltage Vrom can be narrowed down, and this enables highly accurate determination. This correction of the adjustment monitor voltage Vrom depending on a difference in temperature between in factory adjustment and in actual operation will be described in detail later.

At Step S18, if the light-source controller 200 determines that the light-quantity monitor voltage Vpd is within the allowable range of light-quantity monitor voltage Vpd with respect to the adjustment monitor voltage Vrom, the process proceeds to Step S20 to be described below. On the other hand, at Step S18, if it is determined that the light-quantity monitor voltage Vpd is not within the allowable range of light-quantity monitor voltage Vpd with respect to the adjustment monitor voltage Vrom, the process proceeds to Step S19. At Step S19, the light-source controller 200 temporarily holds error information that malfunction occurs in the channel currently set as a light emitting channel. Here, the light-source controller 200 can use the RAM area 412*a* as a location where the error information is temporarily held. Then, the process proceeds to Step S20.

At Step S20, the light-source controller 200 determines whether the current light emitting channel is the channel at the other end of the laser beam source 208 (the channel ch8, in this example). If it is determined that the current light emitting channel is not the channel at the other end of the laser beam source 208, the process proceeds to Step S21. At Step S21, the light-source controller 200 sets the channel at the other end of the laser beam source 208 (the channel ch8) as a light emitting channel, and the process returns to Step S14.

On the other hand, at Step S20, if it is determined that the current light emitting channel is the channel at the other end of the laser beam source 208, the process proceeds to Step S22. At Step S22, the light-source controller 200 determines whether an error occurs in either one of the two channels at both ends of the laser beam source 208 with reference to the location where the error information is temporarily held.

If it is determined that an error occurs in either one of the two channels at both ends of the laser beam source 208, the process proceeds to Step S23. As described above with reference to FIGS. 7A to 7C, when there is misalignment of an optical axis of a monitor beam of the laser beam source 208 with respect to the light receiving surface 218*a* of the light receiving element 218, a monitor beam of any one of the two channels at both ends of the laser beam source 208 deviates from the light receiving surface 218*a*. Therefore, at Step S23, the light-source controller 200 determines that there is misalignment of the optical axis of the monitor beam with respect to the light receiving element 218. Then, the light-source controller 200 notifies the upper system or the like of error information indicating the optical-axis misalignment or displays the error information on a display unit (not shown). Then, a series of processes shown in the flowchart of FIG. 8 is terminated.

On the other hand, at Step S22, if the light-source controller 200 determines that errors occur in both of the channels at both ends of the laser beam source 208 or that an error occurs in neither of the channels at both ends of the laser beam source 208, the process proceeds to Step S24. At Step S24, the light-source controller 200 determines whether errors occur in both of the channels at both ends of the laser beam source 208.

If it is determined that errors occur in both of the channels at both ends of the laser beam source 208, the process proceeds to Step S25. As described above with reference to FIGS. 7A to 7C, when respective light-quantity monitor voltages Vpd generated by the monitor beams of the channels at both ends of the laser beam source 208 are both equal to or lower than a predetermined value, there is a possibility of degradation of the laser beam source 208. Therefore, at Step S25, the light-source controller 200 determines that the laser beam source 208 is degraded, and notifies the upper system or the like of error information indicating degradation of the laser beam source 208 or displays the error information on a display unit (not shown). Then, a series of processes shown in the flowchart of FIG. 8 is terminated.

On the other hand, at Step S24, if it is determined that an error occurs in neither of the channels at both ends of the laser beam source 208, it can be determined that there is no misalignment of the optical axis of the monitor beam of each channel of the laser beam source 208 with respect to the light receiving element 218 and also that the laser beam source 208 is not degraded. In this case, a series of processes shown in the flowchart of FIG. 8 is terminated.

In the flowchart of FIG. 8, when the series of processes is terminated upon determination that there is no misalignment of the optical axis of the monitor beam of each channel of the laser beam source 208 with respect to the light receiving element 218, for example, at the start of printing, the CPU 400 transmits a control signal for starting the APC in synchronization with a synchronization signal output from the synchronization detecting unit 220 and a light quantity of laser beam to illuminate the photosensitive drum subject to the APC to the light-source controller 200. The light-source controller 200 performs feedback control in which respective values of drive currents for the channels of the laser beam source 208 are calculated and set in the drive-current control unit 204 on the basis of respective light-quantity monitor voltages Vpd for the channels obtained in synchronization with the synchronization signal and a relation between a light quantity of laser beam to illuminate the photosensitive drum and a light-quantity monitor voltage Vpd of each of the channels stored in the ROM area 412*b* of the microcontroller 401 in advance.

As described above, according to the present first embodiment, when the front monitoring method of APC is performed on a light quantity of laser beam emitted from the laser beam source 208, before the APC is performed, the laser beam source 208 is caused to emit a laser beam with a drive current $I_0$ required to emit a prescribed light quantity $L_0$ of laser beam, which is measured in factory adjustment in advance, and a light-quantity monitor voltage Vpd based on an output from the light receiving element 218 is checked.

Therefore, as compared with the conventional technology in which an output from a PD is checked by means of light emission with a common fixed drive current, determination of a light-quantity monitor voltage Vpd can be performed with a higher degree of accuracy, and optical-axis misalignment can be detected more easily. At this time, a light-quantity monitor voltage Vpd of a channel (a light emitting spot) at the end of the laser beam source 208 is checked; therefore, optical-axis misalignment can be detected regardless of a direction of misalignment of the optical axis with respect to the laser beam array. Furthermore, if abnormality of the light-quantity monitor voltage Vpd is detected in both of the channels at both ends of the laser beam source 208, it can be determined that not optical-axis misalignment but degradation of the light source has occurred.

Correction in the Event of Temperature Change

Figure 9:
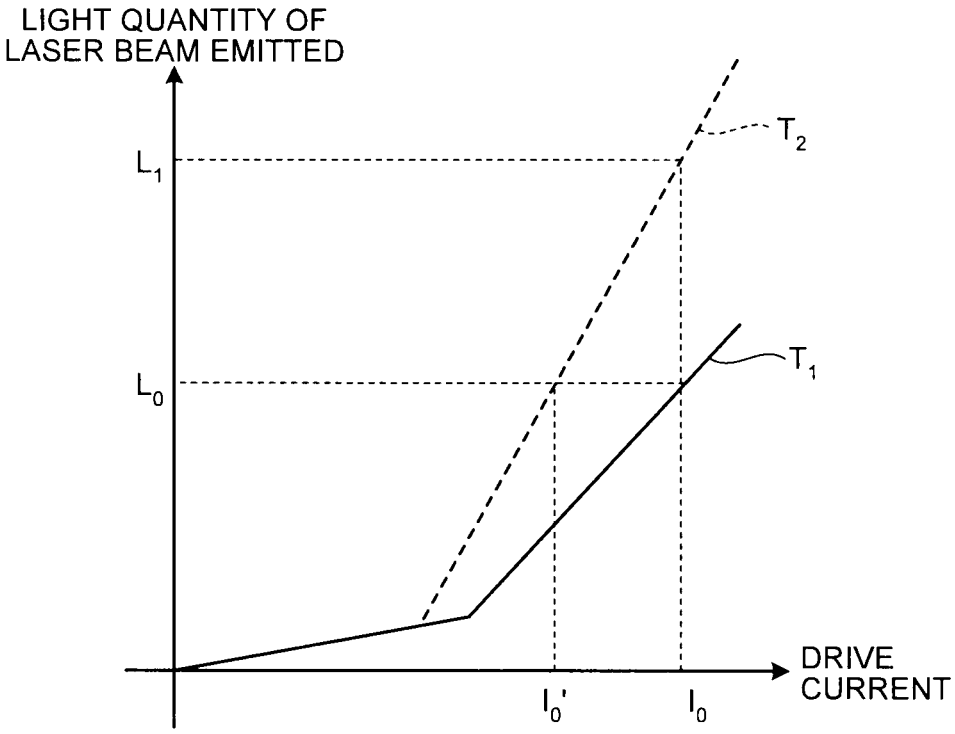
FIG. 9 is a schematic diagram showing examples of a relation between a drive current I and a light quantity L of a laser beam emitted from the LD when ambient temperature is a temperature $T_1$ and when the ambient temperature is a temperature $T_2$ (temperature $T_1$>temperature $T_2$)

Correction of a light quantity of a laser beam emitted from each channel of the laser beam source 208 in the event of temperature change is explained. The LD varies in light emission characteristics according to ambient temperature. FIG. 9 shows examples of a relation between a drive current I and a light quantity L of a laser beam emitted from the LD when the ambient temperature is a temperature $T_1$ and when the ambient temperature is a temperature $T_2$ (temperature $T_1$>temperature $T_2$). In this manner, when the temperature around the LD is the temperature $T_2$, the LD emits a larger light quantity of laser beam with the same drive current I as when the ambient temperature is the temperature $T_1$.

It is conceivable that temperature around the LD (the laser beam source 208) in the image forming apparatus 20 differs between in factory adjustment and in actual operation. For example, it is assumed that the temperature around the laser beam source 208 is the temperature $T_1$ at the time of factory adjustment and is the temperature $T_2$ when the image forming apparatus 20 is in actual operation, and a prescribed light quantity $L_0$ of laser beam from a channel of the laser beam source 208 is obtained with a drive current $I_0$ in factory adjustment.

In this case, while the image forming apparatus 20 is in actual operation, when the channel of the laser beam source 208 is driven with the drive current $I_0$ with which the prescribed light quantity $L_0$ is obtained in the factory adjustment, a light quantity $L_1$ of a laser beam emitted from the channel is higher than the prescribed light quantity $L_0$. Therefore, the channel of the laser beam source 208 is driven with a drive current $I_0'$ that the drive current $I_0$ is corrected based on a degree of change in temperature from the temperature $T_1$ to the temperature $T_2$, so that the channel can emit a laser beam of the prescribed light quantity $L_0$ under the condition of the temperature $T_2$.

The correction of the drive current $I_0$ based on a degree of change in temperature is performed, for example, as follows. In measurement of the drive current $I_0$ with which the prescribed light quantity $L_0$ of laser beam is emitted in factory adjustment as described above, a temperature around the laser beam source 208 is also measured, and a result of the measurement is written on the ROM area 412*b*. This temperature around the laser beam source 208 in the factory adjustment is referred to as a temperature $T_0$. When a rate of change in light quantity of a laser beam emitted from the laser beam source 208 due to a change in temperature is denoted by $K_1$[%/° C.], a corrected drive current $I_0'$ is obtained by the following equation (1).

$$I_0' = I_0 \times \{1 + K_1 \times (T_2 - T_1)\} \quad (1)$$

The light-source controller 200 performs correction on the drive current $I_0$ obtained at Step S12 in the above-described flowchart of FIG. 8 based on a difference between the temperatures shown in the equation (1), and sets the obtained drive current $I_0'$ in the light emitting channel at Step S14.

Incidentally, the temperature around the laser beam source 208 when the image forming apparatus 20 is in actual operation is measured by the temperature sensor 222 placed near the laser beam source 208 in the image forming apparatus 20.

If a light-quantity monitor voltage Vpd, which is an output voltage from the light receiving element 218, also has temperature characteristics, by correcting an adjustment monitor voltage Vrom based on a difference between the temperature $T_1$ and the temperature $T_2$ in the same manner as above, misalignment of the optical axis of the monitor beam with respect to the light receiving element 218 can be detected with a higher degree of accuracy. In this case, in the same manner as the case of the drive current $I_0$ described above, in measurement of the drive current $I_0$ with which the prescribed light quantity $L_0$ of laser beam is emitted in factory adjustment and an adjustment monitor voltage Vrom, a temperature $T_0$ around the laser beam source 208 is also measured, and a result of the measurement is written on the ROM area 412*b*.

When a rate of change in output from the light receiving element 218 due to a change in temperature is denoted by $K_2$[%/° C.], a corrected adjustment monitor voltage Vrom' is obtained by the following equation (2).

$$Vrom' = Vrom/\{1+K_2\times(T_2-T_1)\} \quad (2)$$

The light-source controller 200 performs correction on the adjustment monitor voltage Vrom obtained at Step S17 in the above-described flowchart of FIG. 8 based on a difference between the temperatures shown in the equation (2), and performs determination at Step S18 using the obtained adjustment monitor voltage Vrom'.

By performing these processes, the allowable range of the light-quantity monitor voltage Vpd with respect to the adjustment monitor voltage Vrom described above at Step S18 can be further narrowed down from within a range of plus or minus 10% described above to, for example, within a range of plus or minus 2%, and misalignment of the optical axis of the monitor beam with respect to the light receiving element 218 can be detected with a higher degree of accuracy.

Furthermore, when a difference between the temperature $T_1$ and the temperature $T_2$ is great, if the laser beam source 208 is caused to emit a laser beam with the drive current $I_0$ that correction based on a degree of change in temperature is not performed thereon, a light quantity of the laser beam emitted exceeds the maximum rated light quantity of laser beam emitted from the laser beam source 208, and this may cause degradation or breakdown of the laser beam source 208. By driving the laser beam source 208 with the drive current $I_0'$ that the drive current $I_0$ is corrected based on the difference between the temperature $T_1$ and the temperature $T_2$, such degradation or breakdown of the laser beam source 208 due to an excess drive current can be prevented.

Variation of the First Embodiment

Subsequently, a variation of the first embodiment of the present invention is explained. In the present variation, a value of only one adjustment monitor voltage Vrom used in determination at Step S18 in the flowchart of FIG. 8 is in the channels of the laser beam source 208 collectively. This one adjustment monitor voltage Vrom collectively set in the channels is referred to as a "fixed voltage Vref".

A value of the fixed voltage Vref is determined by considering transmission rates of the channels of the laser beam source 208 and optical components which form a monitor beam and a fluctuation in light receiving sensitivity of the light receiving element 218 among individual variabilities. For example, a value at which the light-quantity monitor voltage Vpd becomes smallest in all combinations when the channels of the laser beam source 208 are each caused to emit a prescribed light quantity of laser beam is set as a fixed voltage Vref.

According to this, as compared with the method to store respective adjustment monitor voltages Vrom of the channels of the laser beam source 208, the accuracy of detection of optical-axis misalignment is inferior; however, it is possible to save capacity of the ROM area 412*b* in which the IL table is stored.

Second Embodiment

Figure 10:
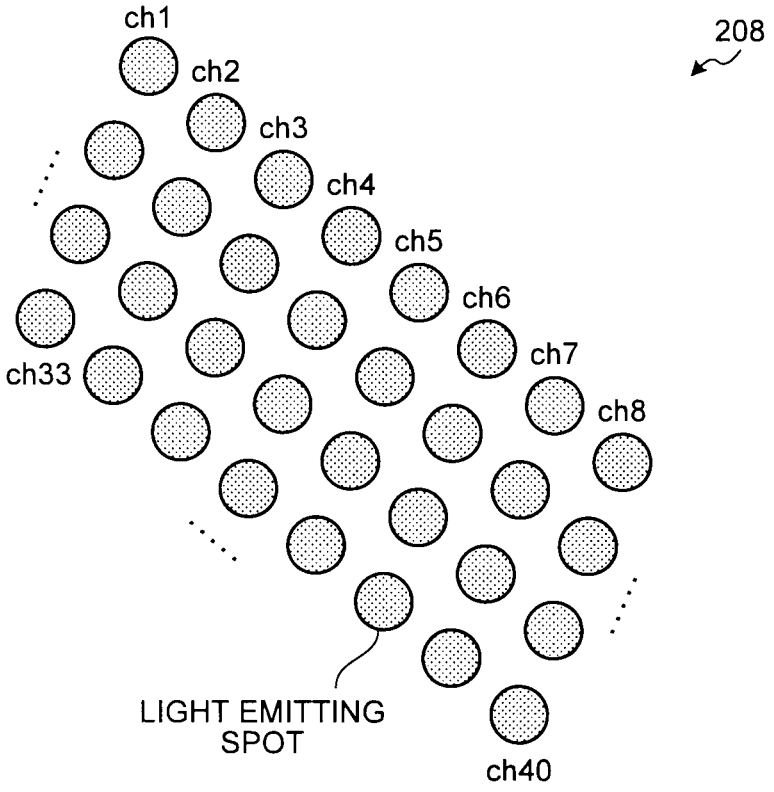
FIG. 10 is a schematic diagram showing an example of an array of light emitting spots in a VCSEL used as the laser beam source.

Subsequently, a second embodiment of the present invention is explained. In the present second embodiment, a VCSEL (Vertical Cavity Surface Emitting LASER) in which a plurality of light emitting spots is two-dimensionally arrayed in the planar form is used as the laser beam source 208. FIG. 10 shows an example of an array of the light emitting spots in the VCSEL used as the laser beam source 208. In the example shown in FIG. 10, one VCSEL has forty light emitting spots, and these forty light emitting spots are arrayed at equally-spaced intervals in a parallelogram grid-like form. Furthermore, in the example shown in FIG. 10, the grid of the light emitting spots is arranged at a predetermined angle to a perpendicular line. In this case, the perpendicular line is, for example, a line at right angles to the scanning direction of a laser beam.

Incidentally, the configuration of the light source unit and the light receiving unit in the optical device 100 described above with reference to FIG. 4 can be applied in the present second embodiment. Likewise, characteristics of the VCSEL on a light quantity of laser beam emitted with respect to a drive current conform to the characteristics of the LD array described above with reference to FIG. 5. Therefore, drive control of the laser beam source 208 can be performed in the same manner as in the first embodiment described above, so detailed description of the drive control of the laser beam source 208 is omitted.

Determination of Optical-Axis Misalignment According to the Second Embodiment Subsequently, a method of determining optical-axis misalignment according to the present second embodiment is explained. Incidentally, also in the present second embodiment, in the same manner as in the first embodiment described above, before determination of optical-axis misalignment is performed, respective drive currents $I_0$ and adjustment monitor voltages Vrom of channels ch1 to ch40 of the laser beam source 208 when the channels ch1 to ch40 each emit a prescribed light quantity $L_0$ of laser beam are measured and stored in the IL table in advance.

FIGS. 11A to 11E show examples of a positional relation between beam spots formed by monitor beams and the light receiving surface 218*a* of the light receiving element 218. Incidentally, in FIGS. 11A to 11E, only beam spots formed by monitor beams of the channels ch1, ch8, ch33, and ch40 located at the vertices of the channel array of the laser beam source 208 are illustrated.

Figure 11A:
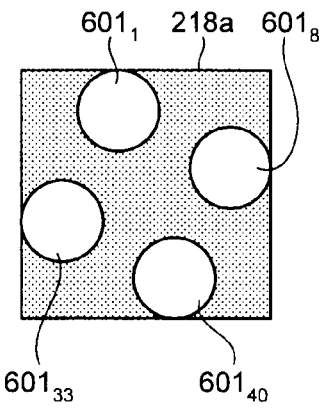
FIGS. 11A to 11E are schematic diagrams showing examples of a positional relation between beam spots formed by monitor beams and the light receiving surface of the light receiving element.

FIG. 11A shows an example in which there is no misalignment of optical axes of the monitor beams with respect to the light receiving element 218. In the same manner as in the first embodiment described above with reference to FIG. 7A, monitor beams and the light receiving element 218 are configured so that beam spots formed by the monitor beams of all the channels of the laser beam source 208 enter the light receiving surface 218*a* of the light receiving element 218 without any lack. In this case, light-quantity monitor voltages Vpd generated by the monitor beams of all the channels are roughly equal to corresponding adjustment monitor voltages Vrom of the channels, respectively.

On the other hand, when there is misalignment of the optical axis of the monitor beam with respect to the light receiving element 218 as shown in FIGS. 11B to 11E, at least any one of beam spots $\mathbf{601}_1$, $\mathbf{601}_8$, $\mathbf{601}_{33}$, and $\mathbf{601}_{40}$ formed by the monitor beams of the channels ch1, ch8, ch33, and ch40 located at the vertices of the channel array of the laser beam source 208 deviates from the light receiving surface 218*a*. A light-quantity monitor voltage Vpd generated by the beam spot which deviates from the light receiving surface 218*a* is lower than the corresponding adjustment monitor voltage Vrom of the channel. Therefore, it is possible to determine whether there is misalignment of the optical axis of any monitor beam with respect to the light receiving element 218 in such a manner that these channels ch1, ch8, ch33, and ch40 are each caused to emit a laser beam separately thereby obtaining a light-quantity monitor voltage Vpd.

Figure 11B:
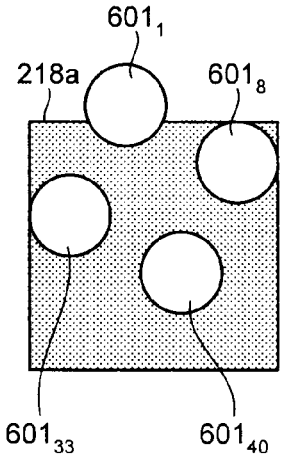
Figure 11C:
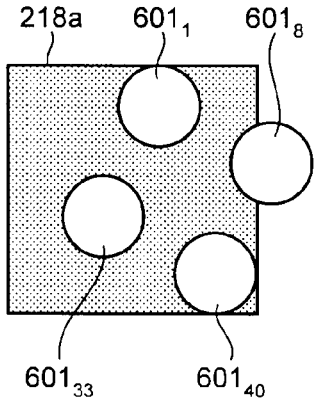
Figure 11D:
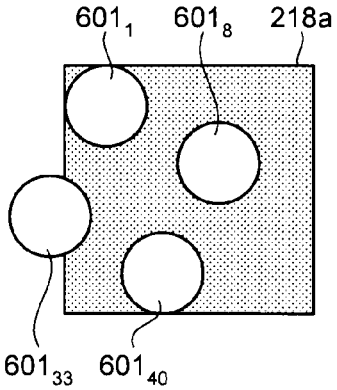
Figure 11E:
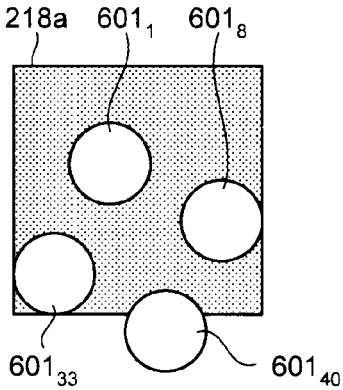

For example, in FIG. 11B, the beam spot $\mathbf{601}_1$ corresponding to the channel ch1 deviates from the light receiving surface 218*a*. It is conceivable that not only this but beam spots formed by monitor beams of two channels which are not located on the same diagonal line out of the channels ch1, ch8, ch33, and ch40 deviate from the light receiving surface 218*a*. In these cases, the beam spot which deviates from the light receiving surface 218*a* (for example, the beam spot corresponding to the channel ch1) enters the light receiving surface in a state where a portion of the beam spot is lacked, and thus a light quantity of the beam spot received by the light receiving surface is smaller than that is when the beam spot enters the light receiving surface 218*a* without any lack. Therefore, for example, a light-quantity monitor voltage Vpd generated by the monitor beam of the channel ch1 is lower than the corresponding adjustment monitor voltage Vrom, and thus it can be determined that there is misalignment of the optical axis of the monitor beam with respect to the light receiving element 218.

In this manner, in the present second embodiment, in the same manner as in the first embodiment, channels that there is no channel next to one side thereof on the line of the channel array are each caused to emit a laser beam separately, thereby obtaining a light-quantity monitor voltage Vpd. More specifically, channels located at the vertices of the channel array of the laser beam source 208 are each caused to emit a laser beam separately, thereby obtaining a light-quantity monitor voltage Vpd. Then, the obtained light-quantity monitor voltage Vpd is compared with the corresponding adjustment monitor voltage Vrom of the channel, and whether there is misalignment of the optical axis of the laser beam with respect to the light receiving element 218 is determined.

Furthermore, in the case where the channels of the laser beam source 208 are arrayed in the planar form, when the light-quantity monitor voltages Vpd of at least two channels at both ends on the same diagonal line are lower or higher than the corresponding adjustment monitor voltages Vrom of the channels by a predetermined value, it can be considered that the laser beam source 208 is degraded or broken down.

A process for checking optical-axis misalignment according to the present second embodiment is almost identical to the process described above with reference to the flowchart of FIG. 8. In this case, a series of processes at Steps S14 to S21 in the flowchart of FIG. 8 is sequentially performed on the channels ch1, ch8, ch33, and ch40 in the four corners of the laser beam source 208. Then, information on the channel determined at Step S18 that the light-quantity monitor voltage Vpd is out of the allowable range of light-quantity monitor voltage Vpd with respect to the adjustment monitor voltage Vrom is temporarily held at Step S19.

Then, when the processes at Steps S14 to S21 with respect to the channels ch1, ch8, ch33, and ch40 have all been completed, at Step S22, the light-source controller 200 determines whether an error occurs in any one of the channels ch1, ch8, ch33, and ch40. The light-source controller 200 can further determine whether errors occur in two of the channels ch1, ch8, ch33, and ch40 which are not located on the same diagonal line. If the light-source controller 200 determines the occurrence of error(s), the light-source controller 200 determines that there is misalignment of the optical axis of the monitor beam with respect to the light receiving element 218, and gives notice of the optical-axis misalignment or displays an error message indicating the optical-axis misalignment at Step S23.

On the other hand, if the light-source controller 200 determines that errors occur in all of the channels ch1, ch8, ch33, and ch40 in the four corners of the laser beam source 208 or that an error occurs in none of the channels ch1, ch8, ch33, and ch40, the process proceeds to Step S24. When it is determined that errors occur in all of the channels ch1, ch8, ch33, and ch40, the light-source controller 200 determines that the laser beam source 208 is degraded, and gives notice of degradation of the laser beam source 208 or displays an error message indicating degradation of the laser beam source 208.

The determination at Step S24 is not limited to the above; for example, when it is determined that errors occur in two of the channels ch1, ch8, ch33, and ch40 which are located on the same diagonal line, such as the channels ch1 and ch40, it can also be determined that the laser beam source 208 is degraded.

In this manner, even if the laser beam source 208 is a surface-emitting light source such as a VCSEL, when the front monitoring method of APC is performed on a light quantity of laser beam emitted from the laser beam source 208, misalignment of the optical axis of a monitor beam with respect to the light receiving element 218 and degradation of the light source can be detected easily.

According to the present invention, it is possible to detect optical-axis misalignment with respect to a light receiving element when APC of a plurality of laser beams emitted from one element is performed by the front monitoring method.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An optical device comprising:

a light source that includes a plurality of light emitting spots that output laser beams, respectively;

a separating unit that separates each of the laser beams output from the plurality of light emitting spots into a monitor beam and a scanning beam;

a light-quantity measuring unit that measures a light quantity of the monitor beam;

a storage unit in which respective drive currents with which the plurality of light emitting spots of the light source output a prescribed light quantity of laser beams in factory adjustment are stored in advance on a channel-by-channel basis;

a light-source control unit that drives the light source with the drive currents stored in the storage unit and causes the plurality of light emitting spots to output the laser beams; and a determining unit that determines whether or not the light source operates properly based on the prescribed light quantity, which is a value less than a maximum rated light quantity of a laser beam emitted from the light source, and the light quantity of the light source driven with the drive currents according to the channel-by-channel basis and measured by the light-quantity measuring unit.

2. The optical device according to claim 1, wherein the storage unit further stores therein respective prescribed light quantities of monitor beams measured by the light-quantity measuring unit in the factory adjustment in advance, the monitor beams being separated from laser beams output from the plurality of light emitting spots by driving the light source with the drive currents by the separating unit, and the determining unit determines that the light source operates properly when the light quantity measured by the light-quantity measuring unit is within a predetermined range of light quantity with respect to the prescribed light quantity stored in the storage unit.

3. The optical device according to claim 2, further comprising:

a temperature storage unit in which a temperature around the light source when the light source outputs the prescribed light quantity of laser beams in the factory adjustment is stored in advance; and a temperature measuring unit that measures a temperature around the light source, wherein the determining unit obtains a corrected light quantity by correcting the prescribed light quantity of the monitor beam stored in the storage unit according to a difference between the temperature measured by the temperature measuring unit and the temperature stored in the temperature storage unit, and when the light quantity measured by the light-quantity measuring unit is within a predetermined range of light quantity with respect to the corrected light quantity, the determining unit determines that the light source operates properly.

4. The optical device according to claim 1, wherein the plurality of light emitting spots are linearly arrayed, and when a light quantity of a monitor beam into which a laser beam output from any of light emitting spots at both ends of the linearly-arrayed light emitting spots is separated, which is measured by the light-quantity measuring unit, is equal to or lower than a predetermined light quantity with respect to the prescribed light quantity, the determining unit determines that there is misalignment of an optical axis of the monitor beam with respect to the light-quantity measuring unit.

5. The optical device according to claim 4, wherein when respective light quantities of monitor beams into which laser beams output from light emitting spots at both ends of the linearly-arrayed light emitting spots are separated, which are measured by the light-quantity measuring unit, are both out of a predetermined range of light quantity, the determining unit determines that the light source is degraded or broken down.

6. The optical device according to claim 4, further comprising:

a temperature storage unit in which a temperature around the light source when the light source outputs the prescribed light quantity of laser beams in the factory adjustment is stored in advance; and a temperature measuring unit that measures a temperature around the light source, wherein the determining unit obtains a corrected light quantity by correcting the prescribed light quantity of the monitor beam stored in the storage unit according to a difference between the temperature measured by the temperature measuring unit and the temperature stored in the temperature storage unit, and when the light quantity measured by the light-quantity measuring unit is within a predetermined range of light quantity with respect to the corrected light quantity, the determining unit determines that the light source operates properly.

7. The optical device according to claim 1, wherein the plurality of light emitting spots are arrayed in a parallelogram form, and when a light quantity of a monitor beam into which a laser beam output from a light emitting spot at one of vertices of the light emitting spots arrayed in the parallelogram form or each of light emitting spots at two of the vertices which are not located on the same diagonal line is separated, which is measured by the light-quantity measuring unit, is equal to or lower than a predetermined light quantity with respect to the prescribed light quantity, the determining unit determines that there is misalignment of an optical axis of the monitor beam with respect to the light-quantity measuring unit.

8. The optical device according to claim 7, further comprising:

a temperature storage unit in which a temperature around the light source when the light source outputs the prescribed light quantity of laser beams in the factory adjustment is stored in advance; and a temperature measuring unit that measures a temperature around the light source, wherein the determining unit obtains a corrected light quantity by correcting the prescribed light quantity of the monitor beam stored in the storage unit according to a difference between the temperature measured by the temperature measuring unit and the temperature stored in the temperature storage unit, and when the light quantity measured by the light-quantity measuring unit is within a predetermined range of light quantity with respect to the corrected light quantity, the determining unit determines that the light source operates properly.

9. The optical device according to claim 7, wherein when respective light quantities of monitor beams into which laser beams output from light emitting spots at least two of the vertices on the same diagonal line out of the light emitting spots arrayed in the parallelogram form are separated, which are measured by the light-quantity measuring unit, are all out of a predetermined range of light quantity with respect to the prescribed light quantity, the determining unit determines that the light source is degraded or broken down.

10. The optical device according to claim 1, further comprising:

a temperature storage unit in which a temperature around the light source when the light source outputs the prescribed light quantity of laser beams in the factory adjustment is stored in advance; and a temperature measuring unit that measures a temperature around the light source, wherein the light-source control unit corrects the drive current stored in the storage unit according to a difference between the temperature measured by the temperature measuring unit and the temperature stored in the temperature storage unit, and drives the light source with the corrected drive currents.

11. The optical device according to claim 10, further comprising:

a temperature storage unit in which a temperature around the light source when the light source outputs the prescribed light quantity of laser beams in the factory adjustment is stored in advance; and a temperature measuring unit that measures a temperature around the light source, wherein the determining unit obtains a corrected light quantity by correcting the prescribed light quantity of the monitor beam stored in the storage unit according to a difference between the temperature measured by the temperature measuring unit and the temperature stored in the temperature storage unit, and if the light quantity measured by the light-quantity measuring unit is within a predetermined range of light quantity with respect to the corrected light quantity, the determining unit determines that the light source operates properly.

12. An image forming apparatus comprising:

an optical device;

an image forming unit; and a light-quantity control unit, wherein the optical device includes:

a light source that includes a plurality of light emitting spots that output laser beams, respectively;

a separating unit that separates each of the laser beams output from the plurality of light emitting spots into a monitor beam and a scanning beam;

a light-quantity measuring unit that measures a light quantity of the monitor beam;

a storage unit in which respective drive currents with which the plurality of light emitting spots of the light source output a prescribed light quantity of laser beams in factory adjustment are stored in advance on a channel-by-channel basis;

a light-source control unit that drives the light source with the drive currents stored in the storage unit and causes the plurality of light emitting spots to output the laser beams; and a determining unit that determines whether or not the light source operates properly based on the prescribed light quantity, which is a value less than a maximum rated light quantity of a laser beam emitted from the light source, and the light quantity of the light source driven with the drive currents according to the channel-by-channel basis and measured by the light-quantity measuring unit, the image forming unit forms an image using the scanning beam separated by the separating unit, and the light-quantity control unit performs feedback control of drive current to the light-source control unit on the basis of a light quantity of the monitor beam measured by the light-quantity measuring unit.

13. A control method performed by an optical device, the method comprising:

separating, by a separating unit, each of laser beams output from a plurality of light emitting spots included in a light source into a monitor beam and a scanning beam;

measuring, by a light-quantity measuring unit, a light quantity of the monitor beam;

driving, by a light-source control unit, the light source with drive currents stored in a storage unit and causing, by the light-source control unit, the plurality of light emitting spots to output the laser beams, the drive currents with which the light emitting spots of the light source output a prescribed light quantity of laser beams in factory adjustment, respectively, being stored in the storage unit in advance on a channel-by-channel basis; and determining, by a determining unit, whether or not the light source operates properly based on the prescribed light quantity, which is a value less than a maximum rated light quantity of a laser beam emitted from the light source, and the light quantity of the light source driven with the drive currents according to the channel-by-channel basis and measured at the measuring.

* * * * *